US006703775B2

(12) United States Patent
Miyamoto et al.

(10) Patent No.: US 6,703,775 B2
(45) Date of Patent: Mar. 9, 2004

(54) COLOR CATHODE RAY TUBE APPARATUS WITH AN ELECTRON GUN HAVING AN INTERMEDIATE ELECTRODE

(75) Inventors: Noriyuki Miyamoto, Iruma-gun (JP); Hirofumi Ueno, Fukaya (JP); Tsutomu Takekawa, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 280 days.

(21) Appl. No.: 09/841,596

(22) Filed: Apr. 25, 2001

(65) Prior Publication Data

US 2001/0050526 A1 Dec. 13, 2001

(30) Foreign Application Priority Data

Apr. 26, 2000 (JP) ..... 2000-126071
Mar. 21, 2001 (JP) ..... 2001-081278

(51) Int. Cl.[7] ..... H01J 29/50; H01J 29/74; H01J 29/46; H01J 29/58

(52) U.S. Cl. ..... 313/417; 313/412; 313/414; 313/437; 313/449; 313/450; 315/382.1

(58) Field of Search ..... 313/412, 414, 313/417, 437, 449, 450; 315/382.1

(56) References Cited

U.S. PATENT DOCUMENTS 5,250,875 A * 10/1993 Kho ..... 313/414
5,336,444 A * 8/1994 Casey et al. ..... 252/513
5,539,285 A * 7/1996 Iguchi et al. ..... 315/382
6,455,995 B1 * 9/2002 Jang et al. ..... 313/414

FOREIGN PATENT DOCUMENTS

JP 6-124663 5/1994
JP 10-144234 5/1998

* cited by examiner

*Primary Examiner*—Nimeshkumar D. Patel
*Assistant Examiner*—Matt Hodges
(74) *Attorney, Agent, or Firm*—Oblon, Spivak, McClelland, Maier & Neustadt, P.C.

(57) ABSTRACT

In an electron gun for a color cathode ray tube apparatus of this invention, one intermediate electrode is arranged between a final acceleration electrode and a focus electrode that make up a main lens, and a voltage divided by a voltage dividing resistor for dividing a voltage to be applied to the final acceleration electrode is applied to the intermediate electrode. A dynamic voltage which increases along with an increase in deflection amount of an electron beam is applied to the focus electrode, and a dielectric portion is formed between the final acceleration electrode and the focus electrode. This dielectric portion is formed on the intermediate electrode. Hence, elliptical distortion of electron beam spots is decreased on the entire surface of a phosphor screen, thereby providing a color cathode ray tube apparatus with a good performance on the entire surface of the phosphor screen.

6 Claims, 9 Drawing Sheets

PRIOR ART

PRIOR ART

FIG. 4A
PRIOR ART
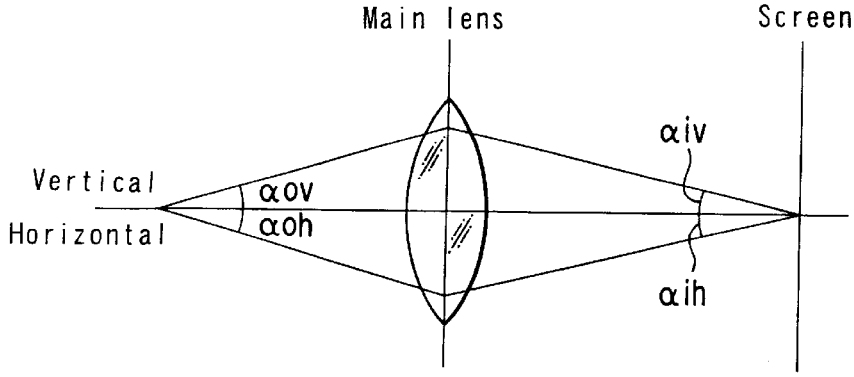
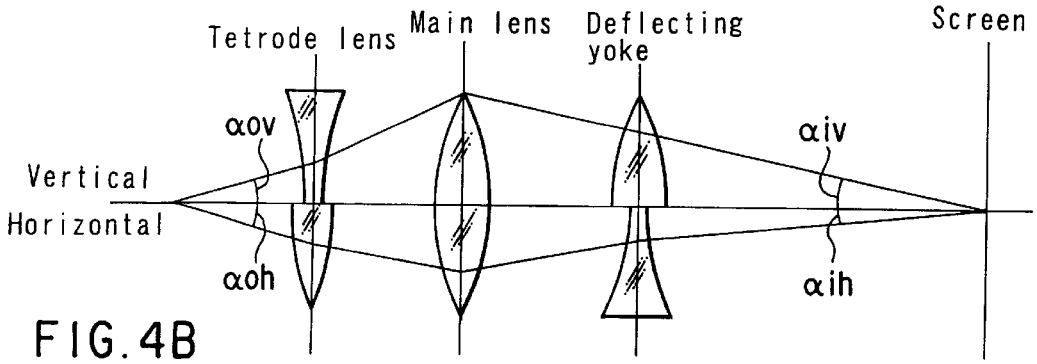
FIG. 4B
PRIOR ART
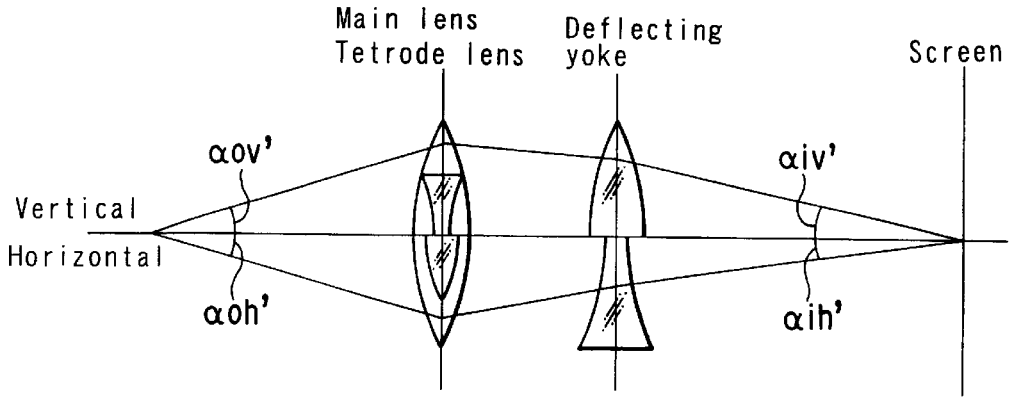
FIG. 5

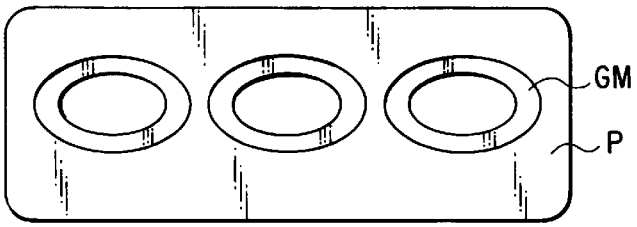
FIG. 11A
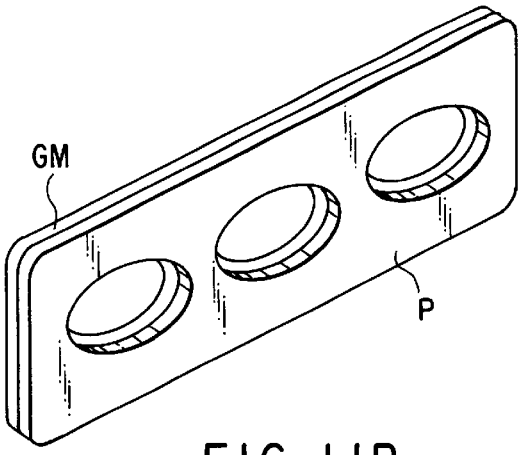
FIG. 11B
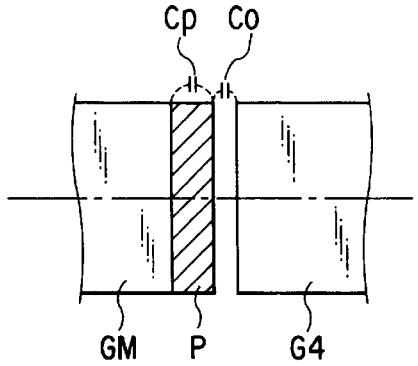
FIG. 11C
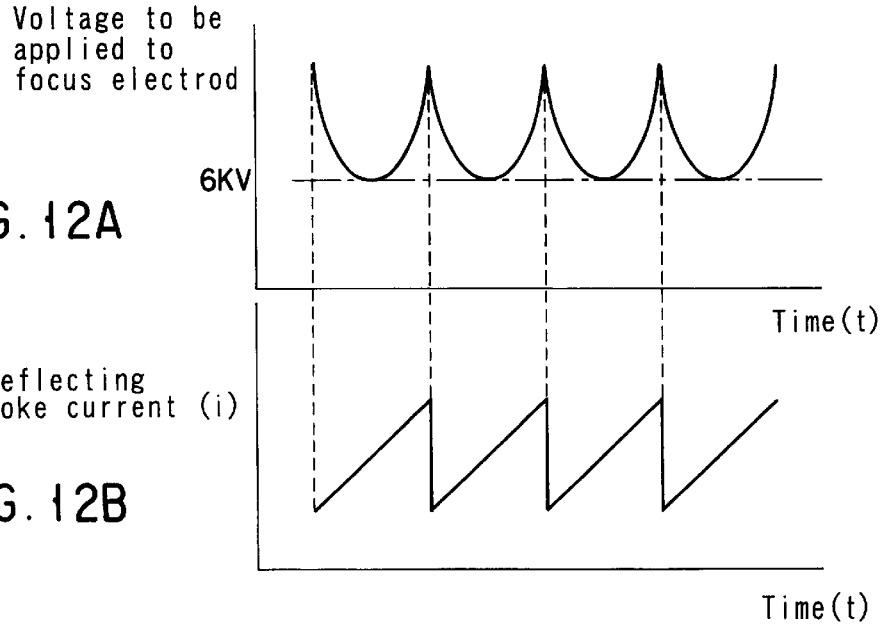
FIG. 12A
FIG. 12B FIG. 17
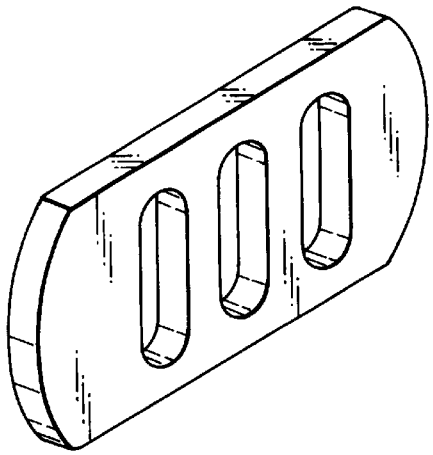
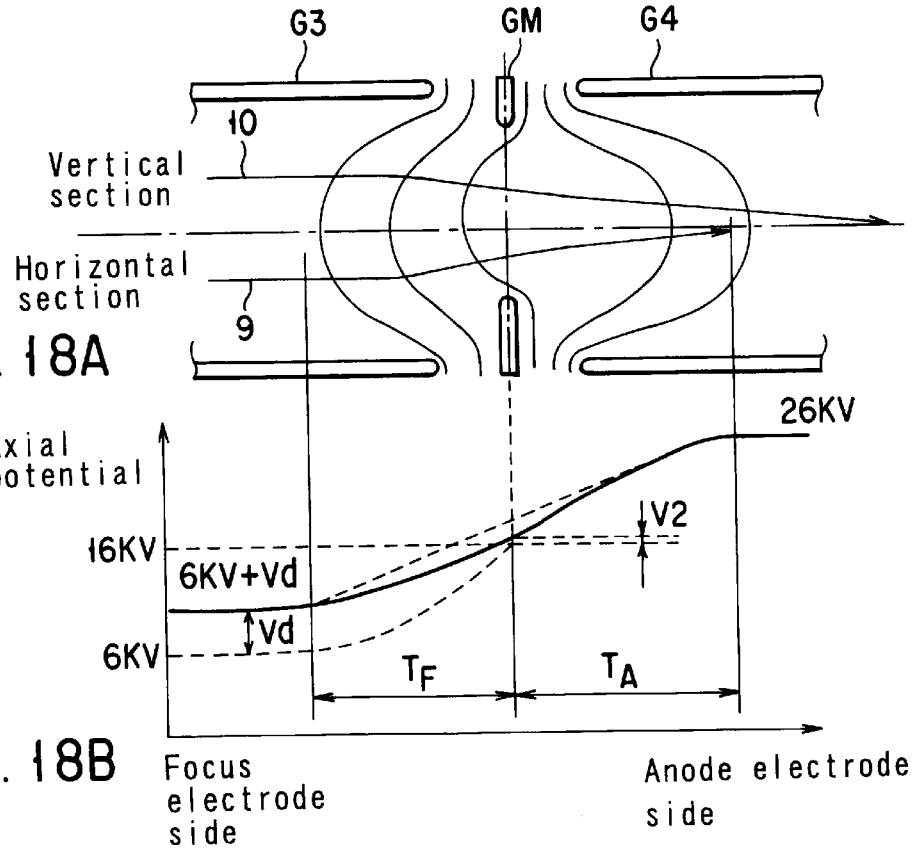
FIG. 18A
FIG. 18B

COLOR CATHODE RAY TUBE APPARATUS WITH AN ELECTRON GUN HAVING AN INTERMEDIATE ELECTRODE

CROSS-REFERENCE TO RELATED APPLICATIONS

This application is based upon and claims the benefit of priority from the prior Japanese Patent Applications No. 2000-126071, filed Apr. 26, 2000; and No. 2001-081278, filed Mar. 21, 2001, the entire contents of both of which are incorporated herein by reference.

BACKGROUND OF THE INVENTION

The present invention relates to a color cathode ray tube and, more particularly, to a color cathode ray tube apparatus in which the elliptical distortion of electron beam spot shapes on the periphery of a phosphor screen is improved to allow displaying an image of good quality.

Generally, as shown in FIG. 1, in a color cathode ray tube, a panel 1 is integrally bonded to a funnel 2, and a phosphor screen 4 comprised of three color phosphor layers for emitting red, green, and blue light is formed on the inner surface of the faceplate of the panel 1. A shadow mask 3 having a large number of electron beam holes is mounted inside the panel 1 to oppose the phosphor screen 4. An electron gun 6 is arranged in a neck 5 of the funnel 2, and three electron beams 7B, 7G, and 7R emitted from the electron gun 6 are deflected by a magnetic field generated by a deflecting yoke 8 mounted on the outer surface of the funnel 2 and are directed toward the phosphor screen 4. The phosphor screen 4 is scanned horizontally and vertically by the deflected electron beams 7B, 7G, and 7R, thereby displaying a color image on the phosphor screen 4.

As a color cathode ray tube of this type, an in-line type color cathode ray tube is available in which the electron gun 6 particularly forms an in-line type electron gun that emits three in-line electron beams made up of a center beam and a pair of side beams traveling on one horizontal plane, while the deflecting yoke generates a non-uniform magnetic field such that the horizontal deflecting magnetic field forms a pincushion type field and the vertical deflecting magnetic field forms a barrel type field, so the three electron beams self-converge.

For the in-line type electron gun for emitting three in-line electron beams, various types and methods are available, and a typical example them is a so-called BPF (Bi-Potential Focus) dynamic focus (Dynamic Astigmatism Correction and Focus) type electron gun. This BPF dynamic focus type electron gun is comprised of first to fourth grids G1 to G4 integrated with each other and sequentially arranged from three in-line cathodes K toward a phosphor screen 4, as shown in FIG. 2. Each of the grids G1 to F4 has three electron beam holes corresponding to the in-line type three cathodes K. In this electron gun, a voltage of about 150 V is applied to the cathodes K, the first grid G1 is grounded, a voltage of about 600 V is applied to the second grid G2, and a voltage of about 6 kV is applied to the (3-1)th and (3-2)th grid G3-1 and G3-2. A high voltage of about 26 kV is applied to the fourth grid G4.

In the above electrode structure to which the above voltages are applied, the cathodes K and the first and second grids G1 and G2 make up a triode for generating electron beams and forming an object point with respect to a main lens (to be described later). A pre-focus lens is formed between the second and (3-1)th grids G2 and G3-1 to pre-focus the electron beams emitted from the triode. The (3-2)th and fourth grids G3-2 and G4 form a BPF (Bi-Potential Focus) main lens for finally focusing the pre-focused electron beams onto the phosphor screen. If the deflecting yoke 8 deflects the electron beams to the periphery of the phosphor screen, a preset voltage is applied to the (3-2)th grid G3-2 in accordance with the deflecting distance. This voltage is lowest when the electron beams are directed toward the center of the phosphor screen and highest when the electron beams are directed toward the periphery of the phosphor screen, thus forming a parabolic wave-shape. As the above electron beams are deflected to the periphery of the phosphor screen, the potential difference between the (3-2)th and fourth grids G3-2 and G4 decreases, and the intensity of the main lens described above is decreased. The intensity of the main lens is minimum when the electron beams are directed toward the periphery of the phosphor screen. As the intensity at the main lens changes, the (3-1)th and (3-2)th grids G3-1 and G3-2 form a tetrode lens. The tetrode is the most intense when the electron beams are directed toward the corners of the phosphor screen. The tetrode lens has a focusing function in the horizontal direction and a divergent function in the vertical direction. Thus, as the distance between the electron gun and phosphor screen increases and the image point becomes far, the intensity at the main lens decreases accordingly. As a result, a focus error based on a change in distance is compensated for, and deflection astigmatism caused by the pincushion type horizontal deflecting field and barrel type vertical deflecting field of the deflecting yoke is compensated for by the tetrode lens.

To improve the image quality of the color cathode ray tube, the focus characteristics on the phosphor screen must be improved. In particular, in a color cathode ray tube in which an electron gun for emitting three in-line electron beams is sealed, the elliptical distortion and blurring, as shown in FIG. 3A, of an electron beam spot which are caused by deflection astigmatism become an issue. In a defection astigmatism compensating method generally called the BPF dynamic focus method (Dynamic Astigmatism Correction Focus method), a low-voltage side electrode which forms the main lens is divided into a plurality of elements such as the (3-1)th and (3-2)th grids G3-1 and G3-2, and a tetrode lens is formed in accordance with the deflection of the electron beams. This method can solve the problem of blurring as shown in FIG. 3B. As shown in FIG. 3B, however, a phenomenon still occurs in which electron beam spots are laterally flattened at the ends of the horizontal axis and the ends of the orthogonal axis of the phosphor screen. This causes a moiré effect due to interference with the shadow mask 3. If electron beam spots form a character or the like, the character cannot be easily recognized.

The phenomenon in which an electron beam spot is laterally flattened will be described with reference to optical models shown in FIGS. 4A, 4B, and 5.

FIG. 4A shows an optical system formed when the electron beams reach the center of the phosphor screen without being deflected, and the loci of the electron beams. FIG. 4B shows an optical system formed when the electron beams reach the periphery of the screen after being deflected by the deflecting magnetic fields, and the loci of the electron beams. The size of the electron beam spot on the phosphor screen depends on a magnification (M), and the magnification of the electron beam in the horizontal direction is defined as Mh and that in the vertical direction is defined as Mv. The magnification M can be expressed as (divergent angle $\alpha o$/incident angle $\alpha i$) shown in FIGS. 4A and 4B.

More specifically,

Mh (horizontal magnification)=αoh (horizontal divergent angle)/αih (horizontal incident angle)

Mv (vertical magnification)=αov (vertical divergent angle)/αiv (vertical incident angle)

When the horizontal divergent angle αoh and vertical divergent angle αov are equal (αoh=αov), in the non-deflection mode shown in FIG. 4A, the horizontal incident angle αih and vertical incident angle αiv become equal (αih=αiv) and the horizontal magnification Mh and vertical magnification Mv become equal (Mh=Mv), and in the deflection mode shown in FIG. 4B, the horizontal divergent angle αoh becomes smaller than the vertical divergent angle αov (αoh<αov), and the vertical magnification Mv becomes smaller than the horizontal magnification Mh (Mv<Mh). In other words, the electron beam spot becomes circular at the center of the phosphor screen but is laterally elongated on the periphery of the phosphor screen.

As described above, in order to improve the image quality of the color cathode ray tube, a good focusing state must be maintained on the entire surface of the phosphor screen, and the elliptic distortion of the electron beam spot must be decreased. In the conventional BPF type dynamic focus electron gun, an appropriate dynamic voltage is applied to the low voltage side of the main lens in order to change the intensity of the main lens, and simultaneously to form a tetrode lens that changes dynamically, so the blur of the electron beam in the vertical direction, which is caused by the deflection aberration, can be eliminated. As a result, focusing can be performed on the entire surface of the phosphor screen. On the periphery of the phosphor screen, however, lateral flattening of the electron beam spot is apparent. This phenomenon occurs because, when the electron beam scans the periphery of the phosphor screen, the horizontal magnification Mh and vertical magnification Mv maintain a relationship Mv<Mh due to the electron lens formed by the electron lens and the astigmatism of the deflecting magnetic field.

As a prior art, a method of adjusting an induced dynamic voltage by newly adding an electrode or capacitor member outside an electron gun assembly is known as in, e.g., Jpn. Pat. Appln. KOKAI Publication No. 6-124633 or Jpn. Pat. Appln. No. 2000-73854. According to this method, when an additional component is to be attached to the electrode, the electrode may deform, thus rendering the focus performance unstable. When the additional component is placed near the neck of the cathode ray tube or another electrode, the breakdown voltage decreases. In addition, welding and addition of a component lead to an increase in the unit price of the electron gun.

According to the method known in Jpn. Pat. Appln. KOKAI Publication No. 2000-260349, dielectric portions are arranged between a plurality of divided focus electrodes, thereby adjusting a dynamic voltage induced in the electrodes connected to a resistor. In this method, since a tetrode lens and dielectric portions are arranged on a side closer to the cathode than the center of the main lens, the difference between the horizontal magnification and vertical magnification cannot be moderated, and improvement of the lateral flattening of the beam spot on the periphery of the screen, which is the object of the present invention, cannot be achieved.

BRIEF SUMMARY OF THE INVENTION

It is an object of the present invention to provide a color cathode ray tube with a good performance on the entire surface of the phosphor screen, in which the elliptic distortion of an electron beam spot is decreased on the entire surface of a phosphor screen.

According to the present invention, there is provided a color cathode ray tube apparatus comprising an electron gun in which a plurality of electron lenses including a main lens for accelerating and focusing an electron beam onto a screen are formed, and a deflecting yoke for deflecting the electron beam emitted from the electron gun in order to scan the screen in horizontal and vertical directions with the deflected electron beam, the main lens of the electron gun being comprised of at least a focus electrode and a final acceleration electrode along at least a traveling direction of the electron beam, wherein the electron gun has at least one intermediate electrode arranged between the final acceleration electrode and the focus electrode that make up the main lens, a voltage divided by a voltage dividing resistor for dividing a voltage to be applied to the final acceleration electrode is applied to the intermediate electrode, a dynamic voltage which increases along with an increase in deflecting amount of the electron beam is applied to the focus electrode, and a dielectric portion is formed between the electrodes that make up the main lens, the dielectric portion being formed on either one of the electrodes.

According to the present invention, there is provided a color cathode ray tube apparatus with the above arrangement, wherein the dielectric portion is provided between the electrode to which the dynamic voltage is applied and the intermediate electrode and is formed on either one of the electrodes, and the intermediate electrode is formed into a disk-like shape and has a non-circular electron beam hole with a major axis in a direction parallel to a horizontal direction of the screen.

According to the present invention, there is also provided a color cathode ray tube apparatus with either one of the arrangements described above, wherein the dielectric portion is provided between the intermediate electrode and the final acceleration electrode and is formed on either one of the electrodes by plating, and the intermediate electrode is formed into a disk-like shape and has a non-circular beam hole with a major axis in a direction parallel to a vertical direction of the screen.

Furthermore, according to the present invention, there is provided a color cathode ray tube apparatus with either one of the arrangements described above, wherein the dielectric portion is made of at least one ceramic or glass material selected from the group consisting of $Al_2O_3$, AlN, $Si_3N_2$, $BaTiO_3$, soda lime glass, $SiO_2$, borosilicate glass, and optical glass.

Furthermore, according to the present invention, there is also provided a color cathode ray tube apparatus with either one of the arrangements described above, wherein a relationship in characteristic curve of thermal expansion between the dielectric portion and a material that forms the electrode on which the dielectric portion is to be formed is set such that a difference in thermal expansion coefficient is not less than continuous 70% of a segment in a range of not less than room temperature and not more than 500° C. is between not less than $5\times10^{-7}$/° C. and not more than $15\times10^{-7}$/° C.

As a method of moderating the difference between the horizontal magnification Mh and vertical magnification Mv, a tetrode lens arranged on the preceding stage of the main lens is formed at the center of the electrode that forms the main lens.

This will be described by using optical models. As described above, FIG. 4B shows a case in a conventional electron gun wherein electron beams reach the periphery of a screen due to a deflecting magnetic field. In FIG. 4B, Mh (horizontal magnification)=αoh (horizontal divergent angle)/αih (horizontal incident angle)

Mv (vertical magnification)=αov (vertical divergent angle)/αiv (vertical incident angle)

It is apparent that Mh>Mv occurs because αih<αiv. More specifically, the above problem is moderated by increasing αih and decreasing αiv.

FIG. 5 shows an optical model in which a tetrode lens is formed at substantially the center of the main lens. In this optical lens, in the same manner as in the models shown in FIGS. 4A and 4B, Mh' (horizontal magnification)=αoh' (horizontal divergent angle)/αih' (horizontal incident angle)

Mv' (vertical magnification)=αov' (vertical divergent angle)/αiv' (vertical incident angle)

As is apparent from comparison of FIGS. 4B and 5, when the tetrode lens becomes closer to the tetrode formed by the deflecting magnetic field, αoh (horizontal divergent angle)=αoh' (horizontal divergent angle)

αov (vertical divergent angle)=αov' (vertical divergent angle)

αih (horizontal incident angle)>αih' (horizontal incident angle)

αiv (vertical incident angle)>αiv' (vertical incident angle)

In other words,

Mh'<Mh

Mv'>Mv are obtained, and the elliptic ratio of the electron beam spot on the periphery of the screen is moderated as shown in FIG. 6.

With the above arrangement, a tetrode lens is formed in the main lens. When a dielectric portion is formed on some of the electrodes that make up the main lens, an electrode that opposes the electrode having the dielectric portion forms a capacitor with an electrostatic capacitance necessary for forming the tetrode lens.

The operation of an electron gun in which a dielectric portion is formed between an electrode to which a dynamic voltage is applied and an intermediate electrode and non-circular electron beam holes with major axes in the horizontal direction are formed in the intermediate electrode will be described.

When the electron beams are not deflected, a voltage is supplied from a voltage dividing resistor to the intermediate electrode such that the potential distribution on the central axis of the electron beam hole from the focus electrode to the final acceleration electrode becomes similar to that of a bi-potential type main lens. For example, when the voltage of the focus electrode is 6 kV, the voltage of the final acceleration electrode is 26 kV, and the intermediate electrode is arranged at the mechanical center of the main lens, the voltage to be supplied to the intermediate electrode is 16 kV, which is an intermediate value between the voltage of the focus electrode and the voltage of the final acceleration electrode. Hence, the field strength from the focus electrode to the intermediate electrode and that from the intermediate electrode to the final acceleration electrode are equal, and potential penetration does not occur near the electron beam holes of the intermediate electrode. Therefore, the main lens constituted by components ranging from focus lens to the final acceleration electrode is equivalent to a bi-potential type electron lens, and the focusing power in the horizontal power and that in the vertical direction become equal.

When the electron beams are deflected, an AC voltage component of the dynamic voltage is induced in the intermediate electrode by the electrostatic capacitance of the capacitor formed with respect to the focus electrode, and the voltage of the intermediate electrode is increased. Hence, the potential distribution on the central axis of the electron beam hole from the focus electrode to the final acceleration electrode becomes different from that of the bi-potential type main lens, and the field strength between the focus electrode and the intermediate electrode becomes higher than that between the intermediate electrode and the final acceleration electrode. Consequently, potential penetration occurs in the final acceleration electrode side through the non-circular electron beam holes formed in the intermediate electrode and with the major axes in the horizontal direction. A tetrode lens with a divergent function in the vertical direction and a focusing function in the horizontal direction is formed in the main lens, and astigmatism occurs in the main lens. Therefore, the blur of electron beam spots on the periphery of the screen is solved, and since the tetrode lens is formed in the main lens, the difference between the horizontal magnification Mh and vertical magnification Mv is decreased, so that the elliptic distortion of the electron beam spots can be moderated.

To sufficiently increase the intensity of the tetrode lens, a higher AC voltage component must be induced in the intermediate electrode. A voltage V1 induced in the intermediate voltage is expressed by the following equation:

$$V1 = \frac{C1}{C1 + C2} Vd$$

where C1 is the electrostatic capacitance of a capacitor formed between the focus electrode and intermediate electrode, C2 is the electrostatic capacitance between the final acceleration electrode and intermediate electrode, and Vd is the AC voltage component of the dynamic voltage to be applied to the focus electrode, as shown in FIG. 7.

Therefore, to obtain a sufficiently high intensity for a tetrode lens, the electrostatic capacitance C1 of the capacitor may be increased. Then, the dynamic voltage V1 induced in the intermediate electrode increases so a large difference is produced between the field strength between the focus electrode and intermediate electrode and the field strength between the intermediate electrode and the final acceleration electrode, thereby increasing the intensity at the tetrode lens in the main lens. In other words, the dynamic voltage necessary for obtaining a tetrode lens with a desired intensity can be decreased.

Generally, in a cathode ray tube, the gap between the electron gun and neck is small, and a space for placing a capacitor with a sufficiently large electrostatic capacitance cannot be ensured.

According to the present invention, the capacitor can be set within the electrode gap of the electron gun assembly. Thus, a capacitor with several 10 pF to several 1,000 pF or more can be obtained by appropriately selecting the material type of the dielectric portion, which is larger than that obtained when the electrostatic capacitance of an arbitrary portion is formed of only a vacuum state. An appropriate combination of dielectric portion materials can make a tetrode lens with a sufficiently high intensity.

If C1 is 18.0 pF and C2 is 2.5 pF, the AC voltage component V1 induced in the intermediate electrode is as follows:

$$V1 = \frac{18.0\text{pF}}{18.0\text{pF} + 2.5\text{pF}} \approx 0.88Vd$$

In other words, about 88% of Vd can be induced in the intermediate electrode, so the intensity at the tetrode lens can be increased.

Component deformation of the intermediate electrode directly influences the focus performance and thus must be prevented as much as possible. Formation of the dielectric portion increases the mechanical strength of the electrode itself. In addition, if the intermediate electrode is fixed to another electrode through the dielectric portion, when the intermediate electrode is to be built in the electron gun assembly, a deforming force may not act on the intermediate electrode itself. As a result, a focus performance can be stably obtained with an inexpensive, simple structure.

With the above operation, the elliptic distortion of the electron beams can be moderated more efficiently, and a stable focus performance can be obtained.

So far a case has been described wherein a dielectric portion is formed between an intermediate electrode and an electrode to which a dynamic voltage is to be applied and non-circular electron beam holes with major axes in the horizontal direction are formed in the intermediate electrode. The same operation can be obtained when a dielectric portion is formed between the intermediate electrode and final acceleration electrode and non-circular electron beam holes with major axes in the vertical direction are formed in the intermediate electrode. The latter case is different from the former case in that the voltage induced in the intermediate electrode is suppressed as much as possible.

In the latter case, a voltage V2 induced in the intermediate electrode is expressed by the following equation:

$$V2 = \frac{C1}{C1 + C2} Vd$$

Therefore, if an electrostatic capacitance C2 of a capacitor formed by the dielectric portion formed between the intermediate electrode and final acceleration electrode is set sufficiently larger than an electrostatic capacitance C1 between a focus electrode and the intermediate electrode, the dynamic voltage V2 induced in the intermediate electrode becomes close to zero, and a change in voltage becomes very small.

Similarly, if C1=2.5 pF and C2=18.0 pF, V2 becomes as follows:

$$V2 = \frac{2.5\text{pF}}{2.5\text{pF} + 18.0\text{pF}} Vd \approx 0.12Vd$$

In other words, the dynamic voltage induced in the intermediate electrode can be suppressed to about 12% of Vd.

As a result, the potential difference with respect to the focus electrode to which the dynamic voltage is applied can be decreased, so a large difference is produced between the field strength between the focus electrode and intermediate electrode and the field strength between the intermediate electrode and final acceleration electrode. Consequently, the intensity at the tetrode lens in the main lens can be further increased, and accordingly the same operation as that described above can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 4A and 4B are views showing conventional electron guns by means of optical lens models;

FIGS. 11A, 11B, and 11C are a plan, perspective, and schematic sectional views, respectively, showing the structure of the disk electrode shown in FIG. 8 on which a dielectric portion is formed;

FIG. 12A is a waveform chart of a voltage to be applied to a focus electrode, and FIG. 12B is a waveform chart showing a deflecting yoke current to be supplied to a deflecting yoke;

FIG. 17 is a perspective view showing the shape of the disk electrode shown in FIG. 16; and FIG. 18A is a sectional view schematically showing the horizontal and vertical sections of the electrode structure shown in FIG. 16 in which a disk electrode is inserted between rotationally symmetric bi-potential lenses, and an equipotential line in the bi-potential lenses, and FIG. 18B is a graph showing a potential on the axis.

DETAILED DESCRIPTION OF THE INVENTION

A color cathode ray tube according to the present invention will be described by way of its embodiments with reference to the accompanying drawings.

Figure 1:
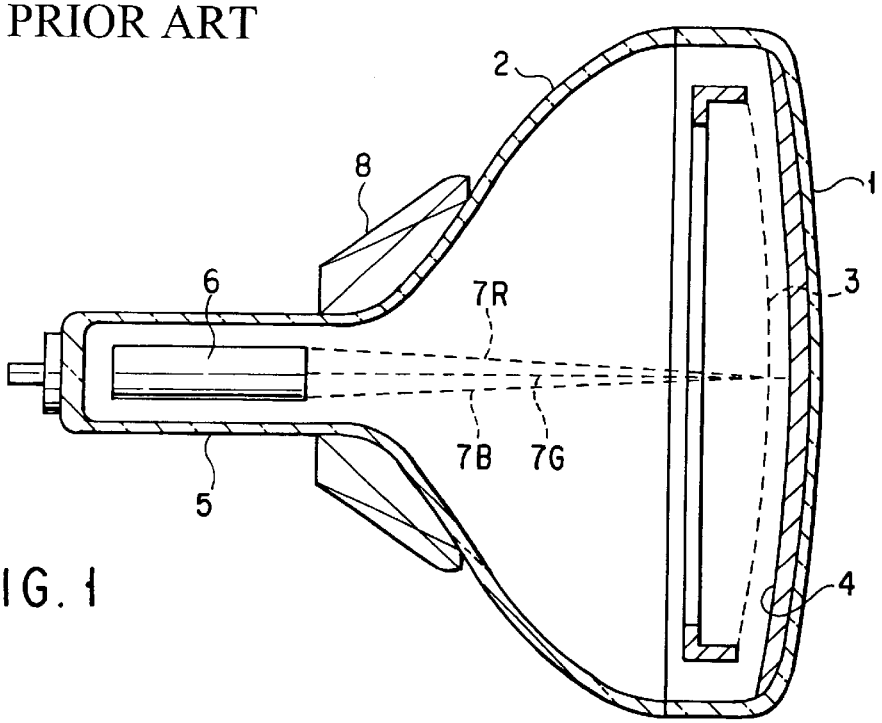
FIG. 1 PRIOR ART
FIG. 1 is a sectional view schematically showing the structure of a general color cathode ray tube.
Figure 2:
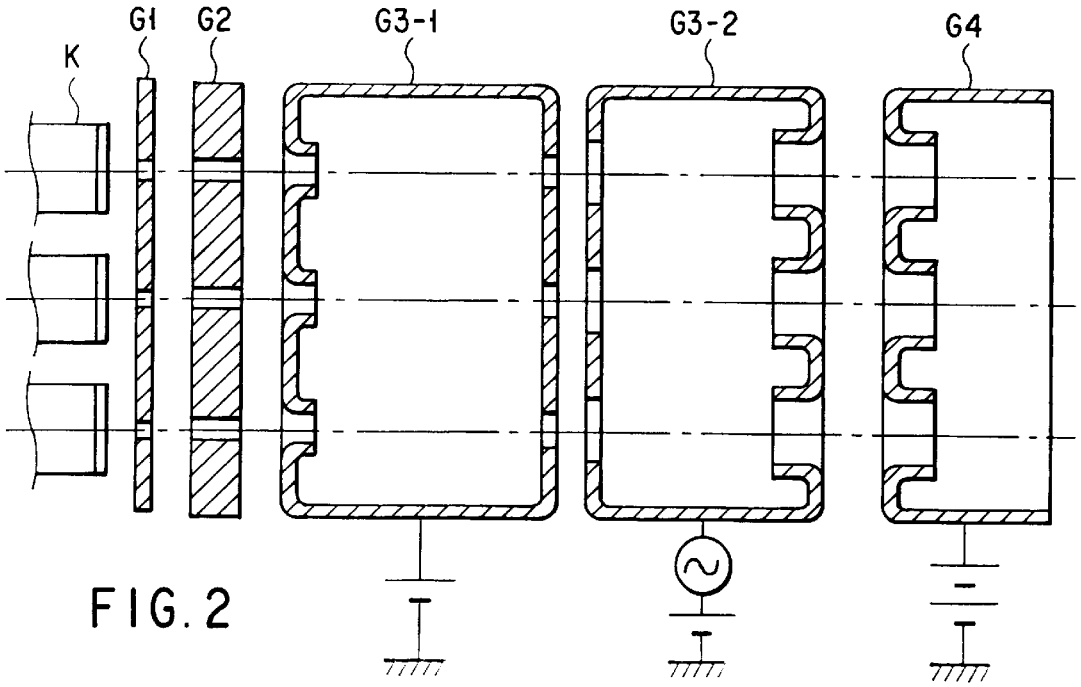
FIG. 2 is a sectional view schematically showing the structure of an electron gun to be built into a conventional color cathode ray tube.
Figure 3A:
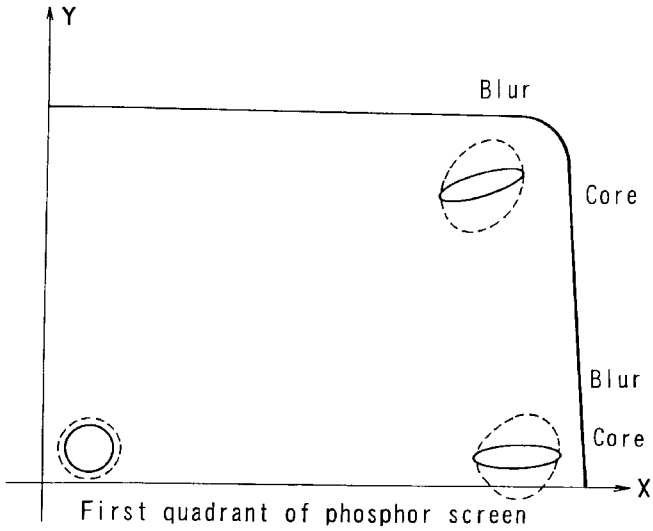
FIG. 3A PRIOR ART
FIGS. 3A and 3B are plan views schematically showing the elliptical distortion of electron beam spots formed on a phosphor screen by the conventional electron gun shown in FIG. 2.
Figure 3B:
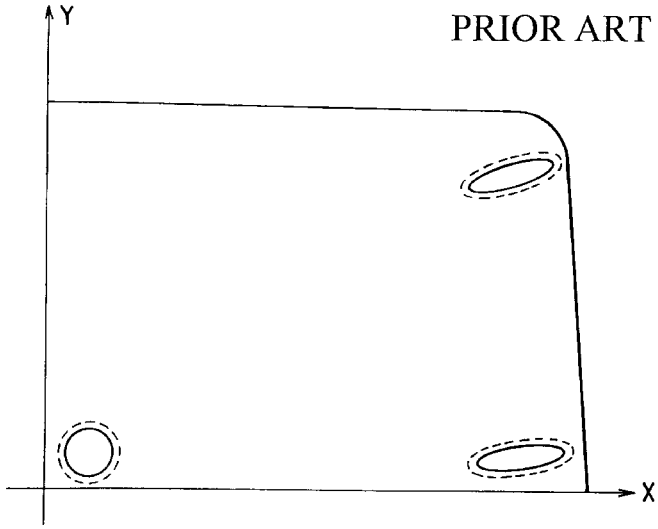
Figure 5:
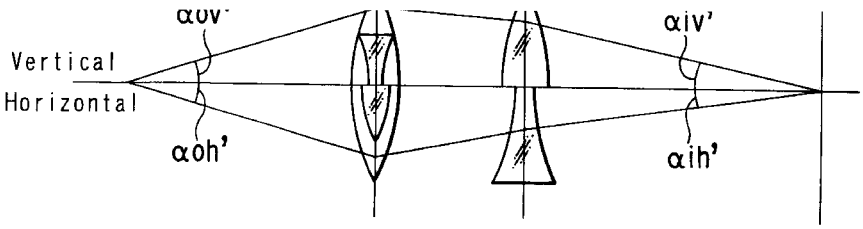
FIG. 5 is a view showing an electron gun assembly to be built in a color cathode ray tube apparatus according to an embodiment of the present invention by means of an optical lens model.

The color cathode ray tube according to the present invention has almost the same structure as that of the general cathode ray tube shown in FIG. 1, and a detailed description thereof will accordingly be omitted. The structure of the cathode ray tube can be understood by referring to FIG. 1 and its description.

Figure 8:
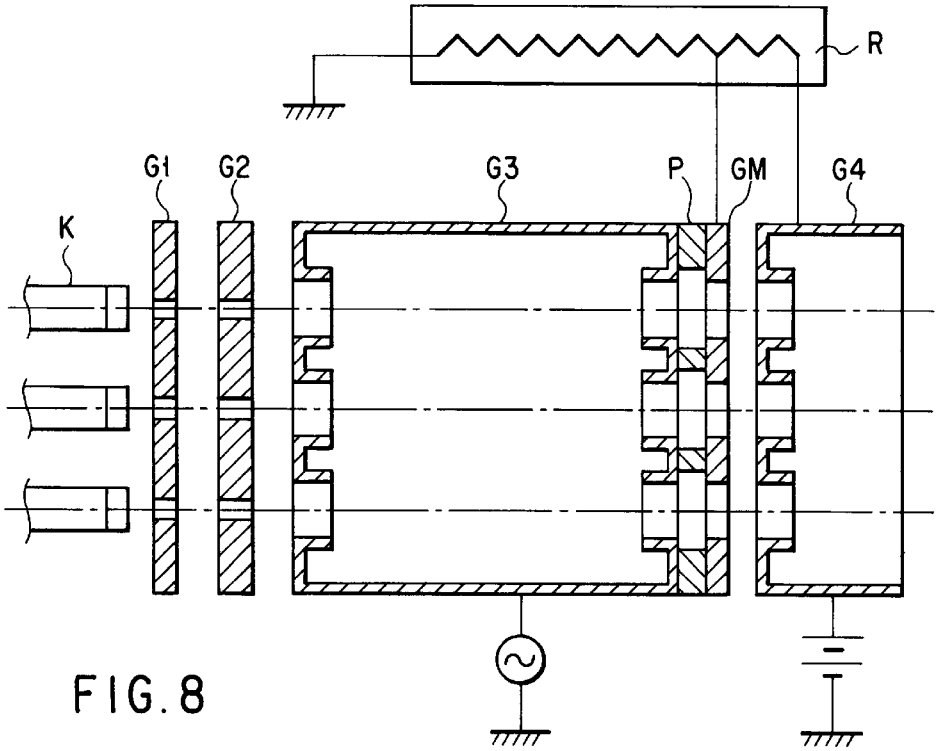
FIG. 8 is a horizontal sectional view schematically showing the structure of the electron gun assembly to be built into the color cathode ray tube apparatus according to the embodiment of the present invention.

FIG. 8 shows the horizontal section of an in-line type electron gun, which emits three in-line electron beams made up of a center beam and a pair of side beams traveling on one horizontal plane, of a color cathode ray tube according to the first embodiment of the present invention. As shown in FIG. 8, the electron gun has three cathodes K, three heaters (not shown) for heating the cathodes K separately, and first to fourth grids G1 to G4 integrated with each other and sequentially arranged on the cathodes K to be adjacent to each other. These components are integrally fixed with a pair of insulating supports (not shown).

Figure 9:
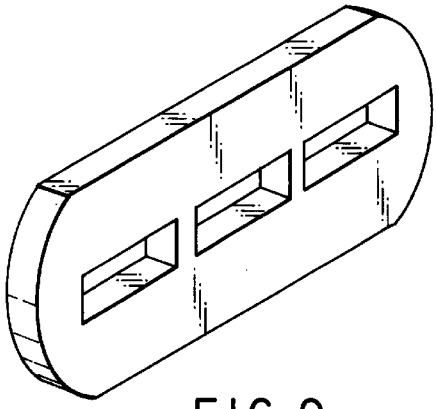
FIG. 9 is a perspective view showing an example of the disk electrode shown in FIG. 8.
Figure 10:
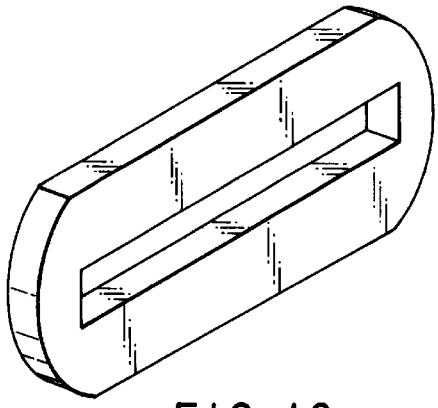
FIG. 10 is a perspective view showing another example of the disk electrode shown in FIG. 8.

Of the grids described above, each of the first and second grids G1 and G2 has a plate-like shape, and three electron beam holes in its plate surface to correspond to the three in-line cathodes K. The third grid G3 serving as a focus electrode is a cylindrical electrode, and has electron beam holes in each of its two ends. The fourth grid G4 serving as the final acceleration electrode also has electron beam holes on the third grid G3 side. A disk electrode GM having laterally elongated non-circular electron beam holes as shown in FIG. 9 or 10 is arranged between the third and fourth grids G3 and G4. A dielectric portion P is formed between the disk electrode GM and third grid G3 so as to fill the gap between them. The gap between the disk electrode GM and third grid G3 and the gap between the disk electrode GM and fourth grid G4 are set equal to each other. The dielectric portion P has openings larger than those in the electrode, as shown in FIGS. 11A and 11B, so as to avoid charging.

In this embodiment, soda lime glass is used to form the dielectric portion. A 50% Ni—Fe alloy as one type of a Ni—Fe based alloy, the characteristic curve of the thermal expansion of which approximates to that of soda lime glass, is used to form the disk electrode GM in order to prevent soda lime glass from peeling off when the component deforms due to thermal expansion.

FIG. 11C is a view showing how the dielectric portion P is arranged. A capacitor is formed between the disk electrode GM formed with the dielectric portion P and the fourth grid G4. An electrostatic capacitance C becomes the sum of an electrostatic capacitance Cρ of a portion where the dielectric portion is present and an electrostatic capacitance C0 of the vacuum space, and is given by the following equation:

$$C = \frac{C\rho \cdot C0}{C\rho + C0}$$

In this embodiment, the dielectric portion is sandwiched between the electrodes, and equation (5) yields C=Cρ.

The electrostatic capacitance Cρ of the capacitor is given by the following equation:

$$C\rho = \varepsilon o \cdot \varepsilon s \frac{s}{d}$$

where d is the gap (corresponding to the thickness of the dielectric portion P in this case) between the disk electrode GM having the dielectric portion and the fourth grid G4, ϵ0 is the dielectric portion constant of a vacuum, and ϵs is the relative dielectric portion constant of the dielectric portion P. The smaller the gap d and the larger s, the larger the capacitance of the capacitor.

In this embodiment, a material satisfying ϵs=7.2 is used to form the dielectric portion. The electrostatic capacitance when the gap between the electrodes is merely a vacuum space is obtained in advance by actual measurement, which is 2.5 pF.

Hence, from equation (6), a total electrostatic capacitance Cp between the electrodes after the dielectric portion P is formed is:

$$Cp = 7.2 \times 2.5$$
$$= 18.0\text{pF}$$

A voltage obtained by superposing a parabolic AC voltage Vd, which increases as the deflecting amount increases, to a voltage of about 6 kV is applied to the third grid G3, as shown in FIG. 12A, in synchronism with a deflecting current shown in FIG. 12B. A voltage of about 26 kV is applied to the fourth grid G4. A voltage of about 16 kV is applied to the disk electrode GM by a voltage dividing resistor R that divides the voltage of the fourth grid G4. The dielectric portion P is formed between the disk electrode GM and third grid G3 so as to fill the gap between them.

Figure 13A:
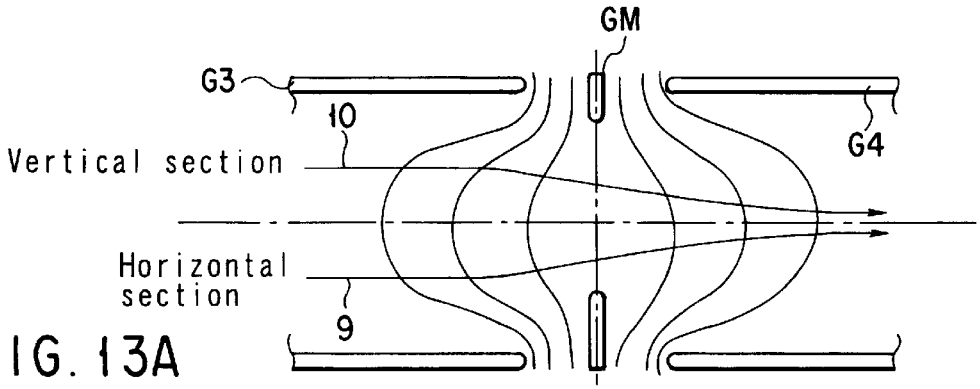
FIG. 13A is a sectional view schematically showing the horizontal and vertical sections of the electrode structure shown in FIG. 8 in which a disk electrode is inserted between rotationally symmetrical bi-potential lenses, and an equipotential line in the bi-potential lenses.
Figure 13B:
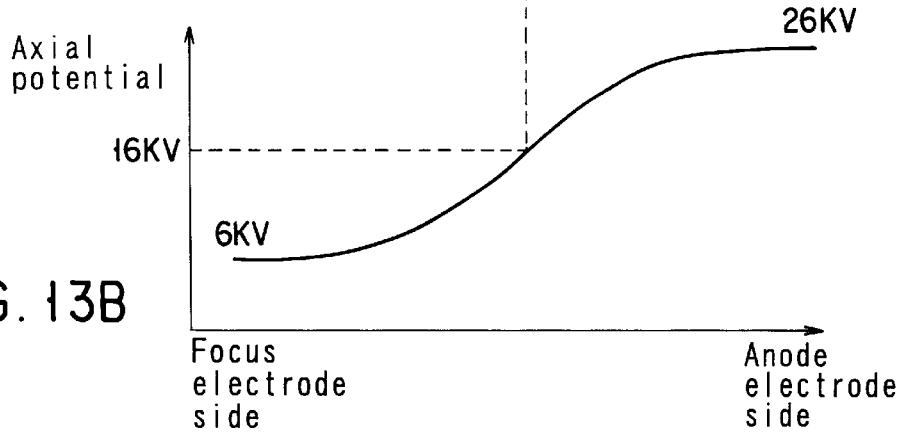
FIG. 13B is a graph showing a potential on the axis.
Figure 14A:
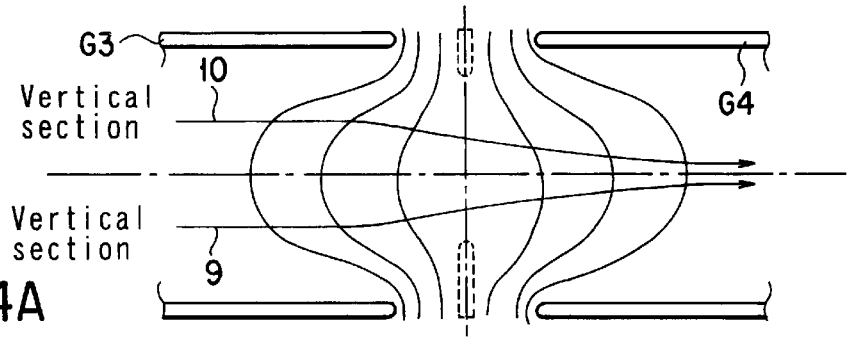
FIG. 14A is a sectional view schematically showing the horizontal and vertical sections of the rotationally symmetric bi-potential lenses, and an equipotential line in the bi-potential lenses.
Figure 14B:
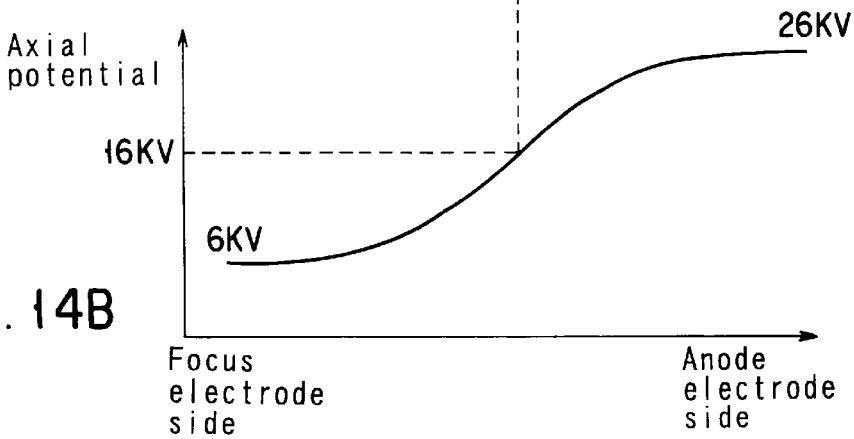
FIG. 14B is a graph showing a potential on the axis.

When the electron beams are not deflected, the main lens formed by the third and fourth grids G3 and G4 has an electric field as shown in FIG. 13A. The electric field shown in FIG. 13A is equivalent to that of a bi-potential type main lens constituted by the third and fourth grids G3 and G4 with no disk electrode GM being arranged between them, as shown in FIG. 14A. Therefore, the main lens constituted by the third and fourth grids G3 and G4 has horizontal and vertical focusing forces equal to each other, and does not have astigmatism. An optical lens model in this state is shown as in FIG. 4 which has already been described above. In the non-deflection state, since the main lens is equivalent to a bi-potential type main lens, the horizontal incident angle αih and the vertical incident angle αiv are equal, and the magnification of the lens in the horizontal direction is equal to that in the vertical direction. Hence, electron beams emitted from the cathodes K pass through the first and second grids G1 and G2, and are focused onto the center of the phosphor screen by the main lens formed of the third and fourth grids G3 and G4, to form substantially circular electron beam spots.

Referring to FIGS. 13A and 14A, reference numeral 9 denotes the locus of an electron beam within a horizontal section; and 10, the locus of an electron beam within a vertical section.

Figure 6:
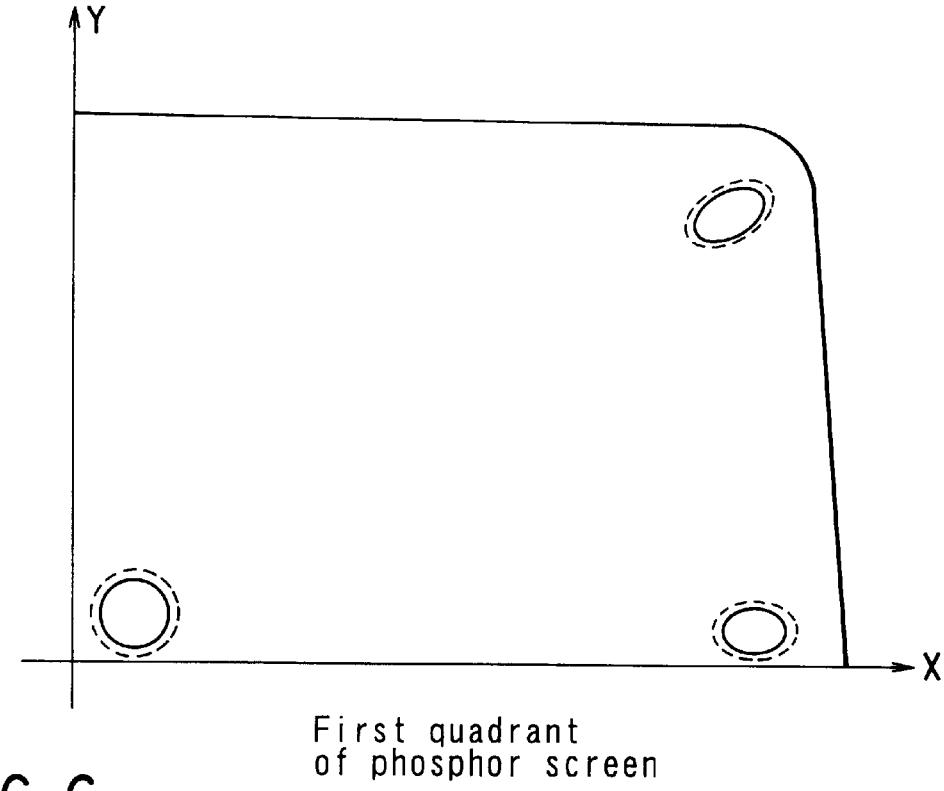
FIG. 6 is a plan view schematically showing a state wherein the ellipse ratio of electron beam spots formed on a phosphor screen by the electron gun with the optical lens model shown in FIG. 5 is improved.
Figure 7:
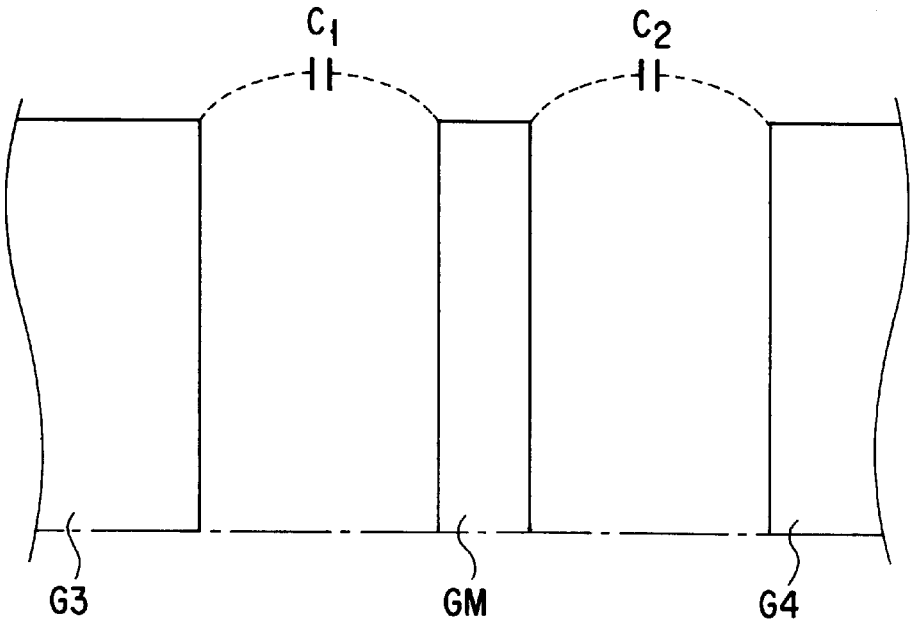
FIG. 7 is a sectional view schematically showing, in an electron gun having an intermediate electrode and to be built into the color cathode ray tube apparatus according to the embodiment of the present invention, electrostatic capacitances produced between the intermediate electrode and other electrodes.
Figure 15A:
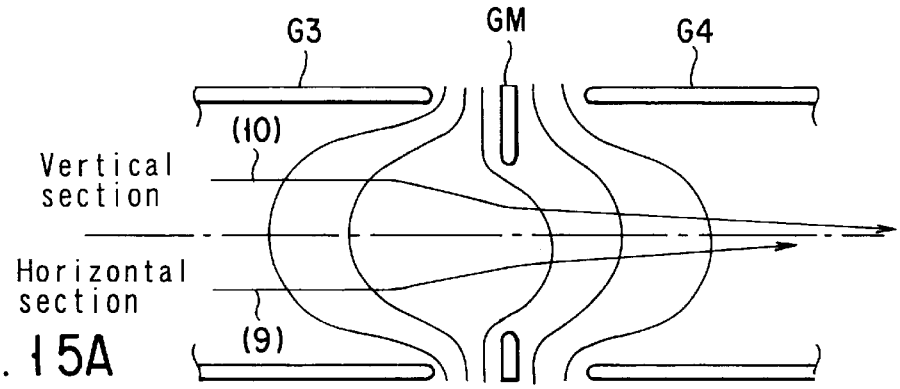
FIG. 15A is a sectional view schematically showing the horizontal and vertical sections of the electrode structure shown in FIG. 8 in which a disk electrode is inserted between rotationally symmetrical bi-potential lenses, and an equipotential line in the bi-potential lenses.
Figure 15B:
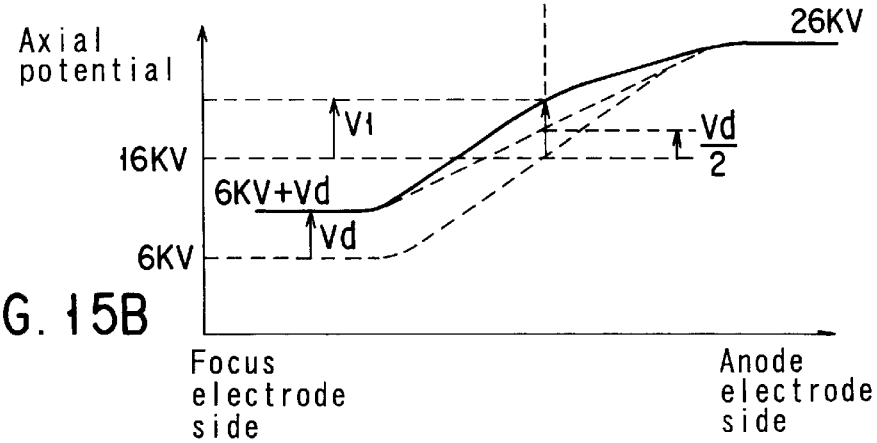
FIG. 15B is a graph showing a potential on the axis.

A case wherein the electron beams are deflected by the deflecting yoke will be described. As the electron beams are deflected by the deflecting yoke to the periphery of the phosphor screen, the voltage of the third grid G3 is increased by the parabolic voltage. As a voltage is supplied to the disk electrode GM from the voltage dividing resistor, the electrostatic capacitance C1 (about 18.0 pF) of the capacitor formed between the third grid G3 and disk electrode GM and the electrostatic capacitance C2 (about 2.5 pF) between the disk electrode GM and fourth grid G4 induce the parabolic AC voltage component V1, and the voltage of the disk electrode changes as shown in FIG. 12A. At this time, V=0.88 Vd. For example, when Vd=600 V, V1=528 V. The main lens formed by the third and fourth grids G3 and G4 at this time has an electric field as shown in FIG. 15A. The potential distribution on the central axis of the electron beam hole is as shown in FIG. 15B. More specifically, as the voltage of the disk electrode increases, the field strength between the third grid and disk electrode becomes higher than that between the disk electrode and fourth grid. Consequently, potential penetration occurs on the final acceleration electrode side through the non-circular electron beam hole formed in the disk electrode and with a major axis in the horizontal direction, and a tetrode lens with a divergent function in the vertical direction and a focusing function in the horizontal direction is formed in the main lens. Hence, the main lens has astigmatism. As a result, blur of the electron beam spots on the periphery of the screen is solved, and the difference between the horizontal magnification Mh and vertical magnification Mv is decreased, so that the elliptic distortion of the electron beam spots can be moderated as shown in FIG. 6.

Figure 16:
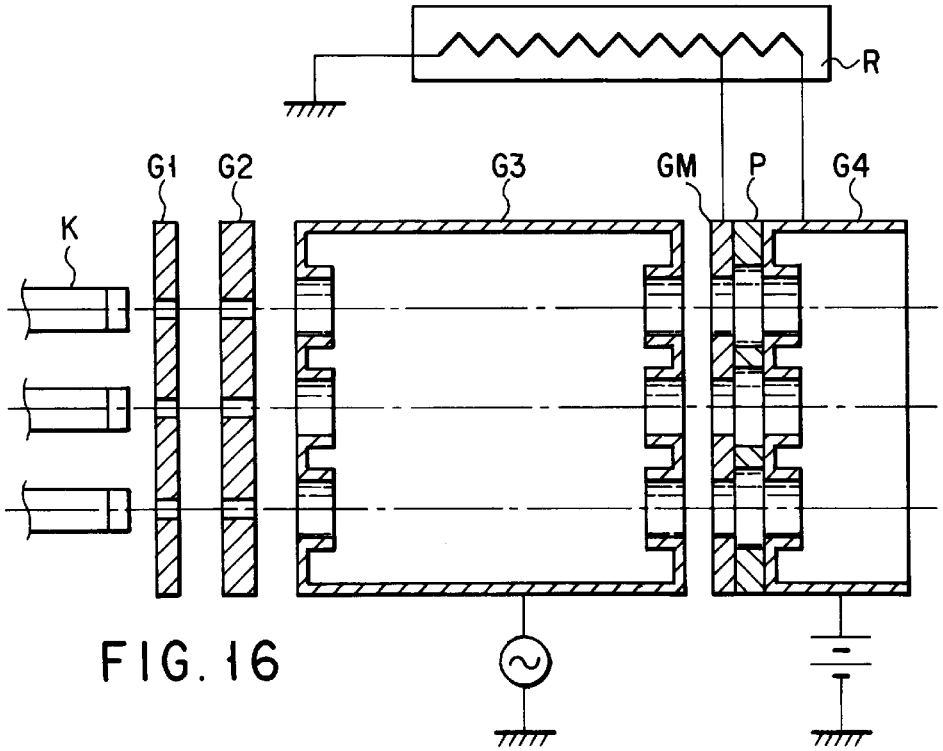
FIG. 16 is a horizontal sectional view schematically showing the structure of an electron gun to be built into a color cathode ray tube according to another embodiment of the present invention.

FIG. 16 shows the horizontal section of an in-line type electron gun, which emits three in-line electron beams made up of a center beam and a pair of side beams traveling on one horizontal plane, of a color cathode ray tube according to the second embodiment of the present invention. The electron gun has three cathodes K, three heaters (not shown) for heating the cathodes K separately, and first to sixth grids G1 to G6 integrated with each other and sequentially arranged on the cathodes K to be adjacent to each other. These components are integrally fixed with a pair of insulating supports (not shown).

Of the grids described above, each of the first and second grids G1 and G2 has a plate-like shape, and three electron beam holes in its plate surface to correspond to the three in-line cathodes K. The third grid G3 serving as a focus electrode is a cylindrical electrode, and has electron beam holes in each of its two ends. The fourth grid G4 serving as the final acceleration electrode also has electron beam holes on the third grid G3 side. A disk electrode GM having longitudinally elongated non-circular electron beam holes as shown in FIG. 17 is arranged between the third and fourth grids G3 and G4. A dielectric portion P is formed between the disk electrode GM and third grid G3 so as to fill the gap between them. The gap between the disk electrode GM and third grid G3 and the gap between the disk electrode GM and fourth grid G4 are set equal to each other. The dielectric portion P has openings larger than those in the disk electrode GM, as shown in FIGS. 11A and 11B, so as to avoid charging. In the same manner as in the first embodiment, soda lime glass is used to form the dielectric portion P, and a 50% Ni—Fe alloy is used to form the disk electrode GM.

A voltage obtained by superposing a parabolic AC voltage Vd, which increases as the deflecting amount increases, to a voltage of about 6 kV is applied to the third grid G3, as shown in FIG. 12A, in synchronism with a deflecting current shown in FIG. 12B. A voltage of about 26 kV is applied to the fourth grid G4. A voltage of about 16 kV is applied to the disk electrode GM by a voltage dividing resistor R that divides the voltage of the fourth grid G4. The dielectric portion P is formed between the disk electrode GM and fourth grid G4 so as to fill the gap between them.

When the electron beams are not deflected, the main lens formed by the third and fourth grids G3 and G4 has an electric field which is equivalent to that of a bi-potential type main lens constituted by the third and fourth grids G3 and G4 with no disk electrode GM being arranged between them, in the same manner as in the first embodiment. Therefore, the main lens constituted by the third and fourth grids G3 and G4 has horizontal and vertical focusing forces equal to each other, and does not have astigmatism. Hence, substantially circular electron beam spots are formed at the central region of the screen.

A case wherein the electron beams are deflected by the deflecting yoke will be described. As the electron beams are deflected by the deflecting yoke to the periphery of the phosphor screen, the voltage of the third grid G3 is increased by the parabolic voltage. As a voltage is supplied to the disk electrode GM from the voltage dividing resistor, an electrostatic capacitance $\alpha$ (about 18.0 pF) of the capacitor formed between the third grid G3 and disk electrode GM and the electrostatic capacitance C2 (about 2.5 pF) between the disk electrode GM and fourth grid G4 suppress induction of the AC voltage component V2, and the voltage of the disk electrode changes only a little. At this time, V2=0.12 Vd. For example, when Vd=600 V, V2=72 V. The main lens formed by the third and fourth grids G3 and G4 at this time has an electric field as shown in FIG. 18A. The potential distribution on the central axis of the electron beam hole is as shown in FIG. 18B. More specifically, as an increase in voltage of the disk electrode GM increases, the field strength between the third grid G3 and disk electrode GM becomes lower than that between the disk electrode GM and fourth grid G4. Consequently, potential penetration occurs on the third grid G3 side through the non-circular electron beam hole formed in the disk electrode and with major axes in the vertical direction, and a tetrode lens with a divergent function in the vertical direction and a focus function in the horizontal direction is formed in the main lens. Hence, the main lens has astigmatism. As a result, blur of the electron beam spots on the periphery of the screen is solved, and the difference between the horizontal magnification Mh and vertical magnification Mv is decreased, so that elliptical distortion of the electron beam spots can be moderated.

In the above embodiments, soda lime glass (manufactured by ASAHI GLASS CO., LTD) is used to form the dielectric portion. It suffices if the dielectric portion is one ceramic or glass material selected from $Al_2O_3$, AlN, $Si_3N_2$, $BaTiO_3$, soda lime glass, optical glass, borosilicate glass, and $SiO_2$, each of which is selected because of its gas emission characteristics. A desired electrostatic capacitance can be obtained by selecting the appropriate type of material.

In the above embodiments, the dielectric portion is formed of one dielectric portion material. Alternatively, the dielectric portion may be formed by combining a plurality of types of dielectric portion materials as far as they are selected from the above members. The dielectric portion can be formed on any electrode without departing from the appended claims.

As the material for forming the electrode which is to be covered by the dielectric portion, a 50% of Ni—Fe alloy is used in the above embodiments. The characteristic curves of the thermal expansion are preferably matched in units of dielectric portion materials to be formed. These characteristic curves will be described based on the result of an experiment performed by using soda lime glass and white plate glass {optical glass (manufactured by SCHOTT)}. The relationship between the characteristic curve of the thermal expansion of a material that forms an electrode on which a dielectric portion is formed, and the characteristic curve of the thermal expansion of the dielectric portion shifts such that a difference in thermal expansion coefficient in continuous 70% or more of a segment in a range of room temperature or more and 500° C. or less is between $5\times10^{-7}$/° C. or more and $15\times10^{-7}$/° C. or less, and more preferably while maintaining the size relationship between the two curves within the work temperature range. Tables 1 and 2 show the results of the experiments performed by the present inventors. Tables 1 and 2 show that, according to these embodiments, a capacitor which is formed well by cladding can be obtained.

TALBE 1

Cladding characteristics depending on combination of electrode material and dielectric portion (glass)

| | Glass 1 | | | | | | |
|---|---|---|---|---|---|---|---|
| | | | Comparative examples | | | | |
| | Embodiments | | | | | 47Ni-6Cr— | 42Ni-6Cr— |
| Electrode material | 52Ni—Fe | 51Ni—Fe | 50.5Ni—Fe | 50Ni—Fe | 49Ni—Fe | Fe | Fe |
| Difference in maximum thermal expansion coefficient ($\times10^{-7}$/° C.)* | 15 | 11 | 15 | 15 | 25 | 30 | 34 |
| Difference in minimum thermal expansion coefficient ($\times10^{-7}$/° C.)* | 6 | 5 | 3 | 0 | 5 | 0 | 0 |
| Positional exchange of expansion curves | No | No | No | Yes | No | Yes | Yes |
| Residual stress (MPa)* | −2.3 | +2.0 | +5.0 | +9.5 | +10.0 | −11.0 | −12.0 |
| Formation state | Good | Good | Partly broken | Partly broken | Broken | Broken | Broken |

| | Glass 2 | | |
|---|---|---|---|
| | Embodiments | Comparative examples | |
| Electrode material | 50Ni—Fe | 47Ni-6Cr—Fe | 42Ni-6Cr—Fe |
| Difference in maximum thermal expansion coefficient ($\times10^{-7}$/° C.)* | 10 | 25 | 29 |
| Difference in minimum thermal expansion coefficient ($\times10^{-7}$/° C.)* | 5 | 0 | 0 |
| Positional exchange in expansion curves | No | Good | Good |
| Residual stress (MPa)* | −1.8 | −30.0 | −24.0 |
| Formation state | Good | Broken | Broken |

* Glass 1: optical glass (B270 manufactured by SCHOTT)
* Glass 2: glass as building material (soda lime glass manufactured by ASAHI GLASS CO., LTD)
* Numeral of electrode material expresses the content wt % of the corresponding metal element
* Difference in thermal expansion coefficient is expressed by absolute value
* "−" and "+" in residual stress respectively represent tensile stress and compressive stress
* Measurement is performed at 30° C. to 500° C.
* Breakage did not occur when glass thickness is 0.1 mm or less

TABLE 2

Relationship between formation state and ratio at which the gradients (coefficient) of thermal expansion curves of the electrode material and dielectric portion (glass) become constant

| | Glass 1 | | | | | | |
|---|---|---|---|---|---|---|---|
| Electrode | Embodiments | | Comparative examples | | | | |
| material | 52Ni—Fe | 51Ni—Fe | 50.5Ni—Fe | 50Ni—Fe | 49Ni—Fe | 47Ni-6Cr—Fe | 42Ni-6Cr—Fe |
| Continuous range (%) | 70 | 83 | 68 | 65 | 60 | 23 | 15 |
| Formation state | Good | Good | Partly broken | Partly broken | Broken | Broken | Broken |

TABLE 2-continued

Relationship between formation state and ratio at which the gradients (coefficient) of thermal expansion curves of the electrode material and dielectric portion (glass) become constant

| | Glass 2 | | |
|---|---|---|---|
| | Embodiment | Comparative examples | |
| Electrode material | 50Ni—Fe | 47Ni-6Cr—Fe | 42Ni-6Cr—Fe |
| Continuous range (%) | 85 | 24 | 15 |
| Formation state | Good | Broken | Broken |

*For what % within the measurement temperature range does a portion where the difference in thermal expansion coefficient is 5 to 15 × $10^{-7}$/° C. continue?
*Measurement is performed at 30° C. to 500° C.

As has been described above, according to the present invention, a color cathode ray tube apparatus with a good image quality can be provided, in which the main lens that focuses the electron beams finally onto the phosphor screen has the effect of astigmatism that changes dynamically, and a capacitor which is formed between electrodes by forming a dielectric portion and which can finely adjust the electrostatic capacitance, so that elliptical distortion of the electron beam spots can be moderated efficiently over the entire surface of the phosphor screen, and a stable focus performance can be obtained.

When the present invention is compared with the method known as the prior art in Jpn. Pat. Appln. KOKAI Publication No. 6-124633 or Jpn. Pat. Appln. No. 2000-73854, according to the formation method of the dielectric portion of the present invention, the mechanical strength of the electrode itself is increased. In addition, since the intermediate electrode is fixed to another electrode through the dielectric portion, when the electrode is to be built into the electron gun assembly, a deforming force does not act on the intermediate electrode itself. Thus, a focus performance can be stably obtained with an inexpensive, simple structure.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube apparatus comprising:

an electron gun in which a plurality of electron lenses including a main lens for accelerating and focusing an electron beam onto a screen are formed; and a deflecting yoke for deflecting the electron beam emitted from said electron gun in order to scan said screen in horizontal and vertical directions with the deflected electron beam, said main lens of said electron gun being comprised of at least a focus electrode and a final acceleration electrode along at least a traveling direction of the electron beam, wherein said electron gun has at least one intermediate electrode arranged between said final acceleration electrode and said focus electrode that make up said main lens, a voltage divided by a voltage dividing resistor for dividing a voltage to be applied to said final acceleration electrode is applied to said intermediate electrode, a dynamic voltage which increases along with an increase in deflection amount of the electron beam is applied to said focus electrode, and a dielectric portion is provided between said electrode to which the dynamic voltage is applied and said intermediate electrode, and is formed on either one of said electrodes, and said intermediate electrode is formed into a disk-like shape and has a non-circular electron beam hole with a major axis in a direction parallel to a horizontal direction of said screen.

2. An apparatus according to claim 1, wherein said dielectric portion is at least one ceramic or glass material selected from the group consisting of $Al_2O_3$, AlN, $Si_3N_2$, $BaTiO_3$, soda lime glass, $SiO_2$, borosilicate glass, and optical glass.

3. An apparatus according to claim 1, wherein a relationship in a characteristic curve of thermal expansion between said dielectric portion and a material that forms said electrode on which said dielectric portion is to be formed is set such that a difference in thermal expansion coefficient is continuous and somewhere between $5\times10^{-7}$/° C. $15\times10^{-7}$/° C. in at least 70% of a temperature range of 30–500° C.

4. A color cathode ray tube apparatus comprising:

an electron gun in which a plurality of electron lenses including a main lens for accelerating and focusing an electron beam onto a screen are formed; and a deflecting yoke for deflecting the electron beam emitted from said electron gun in order to scan said screen in horizontal and vertical directions with the deflected electron beam, said main lens of said electron gun being comprised of at least a focus electrode and a final acceleration electrode along at least a traveling direction of the electron beam, wherein said electron gun has at least one intermediate electrode arranged between said final acceleration electrode and said focus electrode that make up said main lens, a voltage divided by a voltage dividing resistor for dividing a voltage to be applied to said final acceleration electrode is applied to said intermediate electrode, a dynamic voltage which increases along with an increase in deflection amount of the electron beam is applied to said focus electrode, and a dielectric portion is provided between said intermediate electrode and said final acceleration electrode and is formed on either one of said electrodes, and said intermediate electrode is formed into a disk-like shape and has a non-circular beam hole with a major axis in a direction parallel to a vertical direction of said screen.

5. An apparatus according to claim 4, wherein said dielectric portion is at least one ceramic or glass material selected from the group consisting of $Al_2O_3$, AlN, $Si_3N_2$, $BaTiO_3$, soda lime glass, $SiO_2$, borosilicate glass, and optical glass.

6. An apparatus according to claim 4, wherein a relationship in a characteristic cure of thermal expansion between said dielectric portion and a material that forms said electrode on which said dielectric portion is to be formed is set such that a difference in thermal expansion coefficient is continuous and somewhere between $5\times10^{-7}$/C. and $15\times10^{-7}$/C. in at least 70% of a temperature range of 30–500° C.

* * * * *